United States Patent [19]

Jakubowski et al.

[11] 4,272,346

[45] Jun. 9, 1981

[54] TREATMENT OF CARBON FIBERS TO DECREASE ELECTRICAL HAZARDS OF CONDUCTIVE FIBER FRAGMENT RELEASE

[75] Inventors: James J. Jakubowski, Midland, Mich.; Ravanasamudram V. Subramanian, Pullman, Wash.

[73] Assignee: Washington State University Research Foundation, Pullman, Wash.

[21] Appl. No.: 99,516

[22] Filed: Dec. 3, 1979

[51] Int. Cl.[3] ..... C25D 13/12

[52] U.S. Cl. ..... 204/181 R; 204/181 N

[58] Field of Search ..... 204/181 R, 181 N

[56] References Cited

PUBLICATIONS

Subramanian et al., Polymer Eng. & Science, vol. 18, No. 7 (May, 1978) pp. 590–600.

Subramanian et al., 33rd Ann. Technical Conf. Reinf. Plastics/Composites Inst., Soc. of Plastics Ind., Inc., 1978, Sec. 20F pp. 1–8.

*Primary Examiner*—Howard S. Williams

*Attorney, Agent, or Firm*—Wells, St. John & Roberts

[57] ABSTRACT

Carbon fibers are electrocoated by electrodeposition or electropolymerization to facilitate the formation of char, a nonconductive residue or fiber clumps when the coated fibers within a composite are subsequently exposed to fire. Coating materials or precursors are phosphorus compounds, titanates, polyimides, polyquinoxalines, nitriles, or boric acid.

15 Claims, No Drawings

TREATMENT OF CARBON FIBERS TO DECREASE ELECTRICAL HAZARDS OF CONDUCTIVE FIBER FRAGMENT RELEASE

BACKGROUND OF THE INVENTION

The problems that may arise when carbon fibers are accidently released into the environment have been well publicized. Because of its electrical conductivity, carbon, and particularly carbon fiber when released as the result of a fire, might come into contact with electrical and electronic systems and cause unforeseen malfunctions. Because of their very light weight, graphite fibers can float in the air like dust particles and, if they come to rest on electrical circuits, can cause power failures, blackouts, shorts or arcing that can damage equipment. The high electrical conductivity of the carbon fibers has been identified as the prime factor in their effects on electrical equipment, with other properties such as small fiber diameter, generally short length, and low density being important contributory factors.

This disclosure is directed to the application of the techniques of electropolymerization and electrodeposition developed for interphase modification of carbon fiber composites toward a solution to the problems of airborne carbon fiber fragments.

This disclosure results from an investigation of electrochemical coating of graphite fibers by high temperature resistant polymers, organophosphorus and other flame retardant polymers, and organometallic or inorganic materials which function as precursor coatings capable of forming or being converted to highchar, relatively nonconductive residues on graphite fibers during burning of graphite fiber composites. It seeks a solution to the problems arising from the accidental release of electrically conductive graphite fibers from graphite-polymer composites exposed to fire and combustion. It involves the coating of graphite fibers by electropolymerization and electrodeposition, the preparation of composites from the thus coated fibers, and an evaluation of the effectiveness of the precursor coatings in enhancing char formation and fiber clumping during combustion of the composite. It adds a new dimension to interphase modification in composites, studies of which have mainly focused on strength properties. Suitable techniques have previously been developed and reported by the inventors for electropolymerization of monomers and electrodeposition of polymers on graphite fibers, showing that significant improvements in composite strength and toughness result when the coated fibers are incorporated in an epoxy matrix. In the present disclosure, the novel technique of interphase modification by electrocoating processes is applied to the formation of suitable coatings on graphite fibers which result not only in improved composite properties but also in reduced electrical hazards in the event of fire.

The general and specific advantages of the electrochemical processes for coating graphite fibers are:

(a) Techniques are available and previously have been developed for electrocoating commercial graphite fibers used as reinforcement;

(b) Interphase modification of carbon fibers by electrocoating processes has been shown to be effective in improving composite mechanical properties;

(c) Electropolymerization of monomers and electrodeposition of polymers can be conducted on a variety of graphite fiber electrodes;

(d) Chemical and physical structure and other properties of the polymer coatings can be varied by employing different monomers—vinyl, acetylenic, cyclic or other types, and different ionizable polymers;

(e) Further variations in chemical structure and properties can be achieved by copolymerization;

(f) Chemical bond formation, i.e., grafting of polymer to the fiber, may be introduced;

(g) Cross-linked polymer coatings of increased modulus can be formed by employing appropriate multifunctional monomers;

(h) Additional parameters can be controlled, e.g., by varying the nature of solvents and electrolytes employed;

(i) The thickness of the polymer coating can be controlled by modifications of process parameters;

(j) Intermediates for the formation of high temperature resistant polymer coatings such as acetylene terminated polyimides, and polyamic acids are capable of electropolymerization or electrodeposition;

(k) Flame retardant vinyl monomers such as chloro and bromostyrene, 2, 3-dibromopropyl acrylate and 2, 3-dibromopropyl methacrylate are available for electropolymerization to produce precursor coatings.

(l) Vinyl monomers containing flame retardant phosphonate groups, phosphonium salts such as tetrakis (hydroxymethyl) phosphonium sulfate (THP sulfate) are available which can be used in coating graphite fibers by electropolymerization or electrodeposition.

The present invention has been directed to the application of coating materials on carbon fibers by use of electrochemical coating techniques and to a study of the behavior of the carbon fiber polymer composites which include the coated carbon fibers under combustion conditions. The thermal oxidative behavior of the composites was investigated by thermogravimetric analysis. The ability of different types of coating materials or coating material precursors to reduce the potential for accidental release of carbon fibers has been compared.

Organophosphorus as well as inorganic phosphorus-containing flame retardant compounds have been found by us to inhibit combustion by converting organic compounds into char during burning. This is accomplished by formation of phosphoric acid, which promotes char formation. The phosphoric acid which is formed from the phosphorus-containing compounds also forms an insulating layer shielding the unburned organic matter. The resulting phosphorous-containing coatings on the graphite fibers enhance the formation of clumps of fibers during combustion of graphite-polymer composites.

Acetylene terminated polyimide precursors are readily available and have been found by us to polymerize electrochemically on carbon fibers. Since polyimides are more temperature resistant than most other polymer resins (unlike epoxies), polyimide coatings on carbon fibers not only provide protection to a higher temperature, but also remain on the fiber fragments in the event of release. The residual polyimide coating on the fiber fragment, being nonconductive, serves the same purpose as residual char.

The presence of long chain or multiple organic groups in the selected coating compounds is favorable for compatibility or coreaction of the precursor coating with the matrix polymer. For example, the hydroxyl groups in THP have been found by us to react with the epoxy groups of an epoxy resin.

Titanate coupling agents are available which also contain (ionizable) phosphate or pyrophosphate groups, and polymerizable vinyl or acrylic functions in addition to other aliphatic and aromatic groups, amino groups, etc. These organotitanates were found to possess the attributes required to form, by our electrochemical techniques, desirable precursor coatings on graphite fibers which lead to char formation, relatively non-conductive residues and fiber clumps upon exposure to fire. They also provide for effective graphite fiber-polymer interaction, although by a slightly different mechanism than in the case of the mineral fiber composites for which they have been developed. The chemical link between the titanium and the graphite fiber surface can be attributed to the probability of occurrence of transesterification with —C—OH functions on the graphite fiber surface. The attraction of the oppositely charged organotitanium species to the graphite surface during electrodeposition provides a compacted layer of organotitanate on the fiber, as in the case of electrodeposition of polymers. This improves fiber-matrix adhesion. The organic/functional groups of the organatitanate coating further promotes efficient interaction and bonding with the matrix.

The over-all objective of the present invention is to propose coating materials or coating material precursors for graphite fibers which can be applied by electrochemical techniques, which can maintain or preferably, improve composite properties, which would convert to a high electrical resistance coating in situ, and which also result in fiber "clumping" during fire and explosion, thereby to provide a solution to the problems arising from the electrical effects of release of conductive fiber fragments into the environment. Specifically, it is the objective of this invention to:

(1) form high temperature resistant polymer coatings such as polyimides, polyquinoxalines, etc., by electropolymerization of appropriate intermediates carrying acetylene terminal groups;

(2) form polyimide coatings by electropolymerization or electrodeposition of aminophthalic acid, polyamic acids and other suitable intermediates;

(3) form a grafted or coating layer of organophosphorous compounds or polymers by electropolymerization and electrodeposition of suitable organophosphorus monomers and other phosphorous containing compounds onto graphite fibers;

(4) form polymer coatings by the electropolymerization of organotitanates carrying polymerizable groups such as vinyl, or acrylic functional groups;

(5) form organophosphorus-titanate layers by electrodeposition of organotitanates carrying ionizable phosphate or pyrophosphate groups;

(6) form coatings of boric acid and borates by electrodeposition on graphite fibers;

(7) extend the possibility of forming similar precursor coatings by appropriate selection of other classes of monomers and intermediates for electropolymerization and electrodeposition.

GENERAL DISCLOSURE OF METHOD

The first step undertaken herein was the study of the formation of coatings on graphite fibers by electropolymerization and electrodeposition. One general approach involved the polymerization and copolymerization of a variety of appropriate vinyl monomers and other intermediates in the presence or absence of cross-linking agents, onto untreated, commercial carbon fibers in a simple electrolytic cell. The rate of polymerization, the thickness of the polymer layer, cross-link density, and the composition of the copolymers were controlled by experimental variable involved in monomer/solvent/electrolyte system concentrations and electrical current characteristics. The structure, properties and grafting of the polymers formed were investigated. Graphite fibers were also coated by electrodeposition of selected ionic organophosphorus compounds, polyimide intermediates and other suitable species.

The coated fibers were examined by scanning electron microscopy for homogeneity, uniformity and thickness of coating. Composites were made from both types of coated carbon fibers, using thermosetting, (mostly epoxy) resin matrices. The thermaloxidative behavior of the composites was investigated by thermogravimetric analysis. The behavior of composites from the coated fibers was compared to that of composites from untreated commercially obtained fibers.

The experimental methods involved in this disclosure are described in detail in the following sections. The basis for selection of materials, monomers and intermediates for electropolymerization and electrodeposition is also included in this discussion.

ELECTROPOLYMERIZATION AND ELECTRODEPOSITION

Earlier techniques developed by research directed to electropolymerization and electrodeposition on graphite fibers were used in the research leading to this invention. These techniques are described in the following articles incorporated herein by reference:

(1) R. V. Subramanian and James J. Jakubowski, Polym. Eng. Sci., 18, 590 (1978)

(2) R. V. Subramanian, V. Sundaram and A. K. Patel, 33rd Ann. Techn. Conf. SPI Reinf. Plastics/Comp. Inst., 20F (1978)

A three compartment electrolytic cell partitioned by porous glass discs was employed for electropolymization, as described in the above publication (2). Carbon fiber electrodes to be coated were placed in the middle compartment and platinum anodes were placed in the end compartments in order to achieve uniform coating. Polymerization was conducted at constant voltage and, where required, under an inert atmosphere of argon or nitrogen. The applied current density and voltage were varied by a dc regulated power supply unit to control the rate of polymerization and thickness of the polymer formed.

The cells and experimental setup for electrodeposition were those described in the above publication (1) both for batch and continuous electrodeposition. The current was plotted against time by a recorder. Formation of the desired coating was indicated by the current drop. Both anodic and cathodic depositions were conducted by appropriately changing the polarity of the graphite fiber electrodes according to the charge on the electrodeposited ionic species. The choice of aqueous and non-aqueous solvents, bath concentrations, pH, applied voltage, etc., were some of the experimental conditions found amenable for variation in the development and standardization of electrocoating methods. Electrodeposition was conducted from solutions as well as from emulsions in which the surfactants carry the electrical charge and provide electrophoretic mobility for the emulsified nonionic species.

Fibers

Carbon fibers, particularly of the high modulus type which can be obtained commercially without prior surface treatments, were employed as the experimental electrodes for electropolymerization. Thornel, Hitco, Kureha, Fortafil and Celiion are the corporate sources of some commercially available carbon fibers which are appropriate to this method. Of these, Hercules and Fortafil fibers were chosen for initial detailed experimentation. Carbon fibers surface-treated by nitric acid oxidation, were used in comparison to study the effect of the production of functional groups and crystal edges on polymer formation and bonding.

Fiber coating systems

The different types of coating materials or coating precursors evaluated for their potential for increasing char formation and fiber clumping are (1) high temperature resistant flame retardant polymers, (2) organophosphorus compounds and polymers, (3) phosphate and pyrophosphate organotitanates, and (4) boric acid.

(1) High temperature resistant polymers

High temperature resistant polymer coatings may be formed by electropolymerization of acetylene-terminated polyimide (ATI) intermediates, acetylene or nitrile terminated polyquinolxaline (ATQ) oligomers and of 4-aminophtalic acid. Presently, ATI intermediates are commercially available from Gulf Oil Co., as HR 600, 700, etc., and have the following general structure:

$C_6H_5C{\equiv}CH$. The acetylene end-capped quinoxaline oligomers can similarly be electropolymerized on graphite fibers. In the case of 4-aminophtalic acid, it has been postulated that an electron transfer from the carboxylate anion leads to the initial formation of a radical cation which can cyclize to form the aminophthalic anhydride. The anhydride subsequently reacts with the monomer to produce polyimides. Such polymer formation can also occur on graphite fiber electrodes.

In this series of experiments, acrylonitrile shows some promise. The organic, ladder-type polymer has high thermal resistance, as is well known, and the participation of C≡N groups in cyclization during electropolymerization was supported by the facile electropolymerization of benzonitrile, $C_6H_6C{\equiv}CH$. These observations suggest the further use of acrylonitrile, and also benzonitrile in the present method to form thermally stable precursor coatings on graphite fibers.

The electrodeposition of polyimide coatings utilizes polyamic acids. Commercially available polyamic acids are used to form thin-film, thermally stable insulation coating on metal conductors. Such polyamic acids are formed by the reaction of aromatic diamines with aromatic dianhydrides, as in the following example:

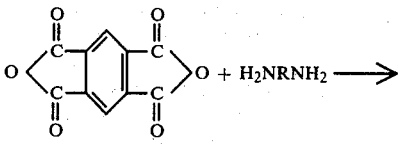

Molecular Structure of Acetylene-terminated Polyimide Oligomers

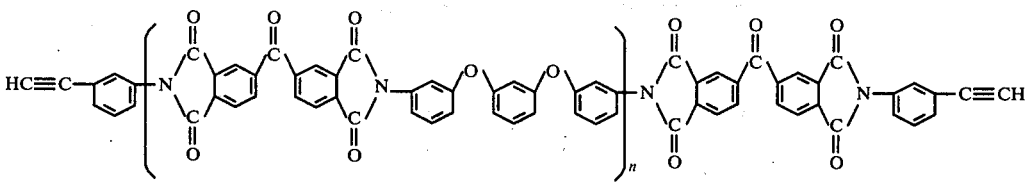

HR600 when n = 1

HR 604 when n = 2

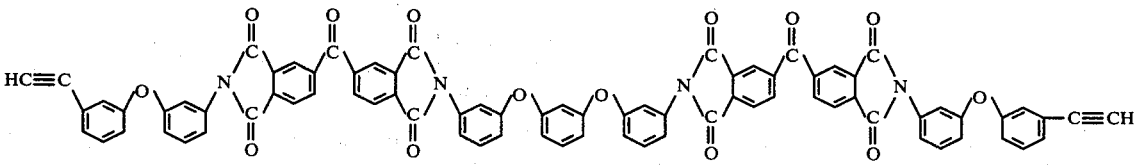

HR650

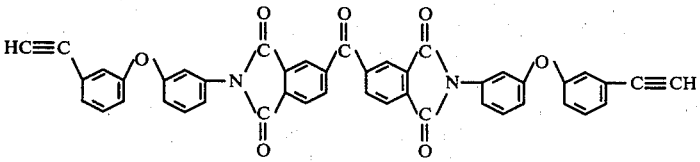

HR700

The electropolymerization of these compounds was achieved in preliminary experiments leading to this disclosure. The participation of the terminal C≡C bonds in electropolymerization is inferred by the formation of linear, conjagated, poly(Phenyl acetylene), $C_6H_5C{\equiv}CH$ by electroinitiated polymerization of -continued

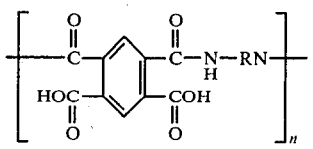

where n is the degree of oligomerization.

As presently used, coatings of polyamic acid are baked to convert them to an inert polyimide. However, the presence of the carboxylic acid groups in the polyamic acid facilitates its electrodeposition on graphite fiber electrodes. Formulations based on commercially available polyamic acids have been developed for formation of coatings on metals from dispersions of amine salts of the corresponding acids in mixed organic solvent systems, and from hydrolytically stable composition in aqueous solutions. These formulations were used in our experiments essentially unmodified, initially, and procedures then were developed for electrodeposition of uniform, adherent, polyimide precursor coatings on graphite fibers. The process of organic electrodeposition is highly complex, involving several mechanisms including electrophoresis, electrocoagulation and electrode reactions. The electrophoretic mobility is affected by the viscosity of the medium and the size, shape and concentration of particles, pH and concentration of electrolyte. The coating experiments were designed to obtain correlation of coating thickness and other properties with current density, bath composition, electrodeposition time, solvent medium, amine, molecular weight of the precursor and other experimental parameters.

The experiments include amide-acid prepolymers, such as the one illustrated by the following structural formula:

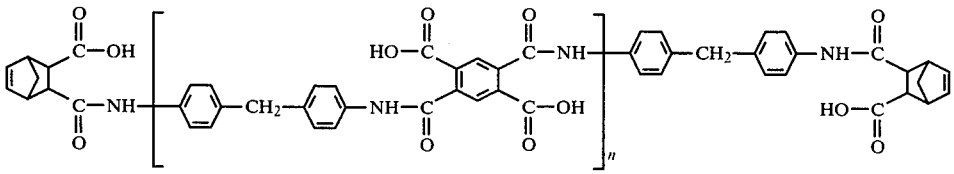

where n is the degree of oligomerization. The reactive alicyclic rings containing unsaturation make this a highly interesting candidate to coat fibers by electropolymerization. Similar polyamic acids E.g., LARC 160, prepared by the use of Jeffamines instead of the methylenedianiline used in the above example, or others prepared using fluorinated diacids can be employed both for electrodeposition and electropolymerization on graphite fibers.

(2) Organophosphorus coatings

The char forming ability of organophosphorus compounds is known. Organosphorphorus monomers that are potentially amenable to electropolymerization are those that have been polymerized by other methods; and are exemplified by the following vinyl phosphonate available commercially as Fyrol 76 from Stauffer Chemical Co., and known to polymerize by free radical initiators.

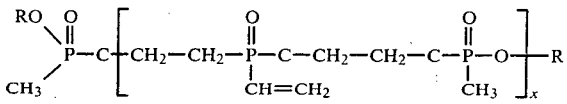

R=alkyl or $HOCH_2CH_2$
Fyrol 76
Vinylphosphonate compound where X is the degree of oligomerization.

Bix-2-chloroethyl vinyl phosphonate, dimethyl allyl phosphonate, trimethallyl phosphite and diallyl phosphite are examples of other unsaturated organophosphorus compounds (Hooker Chemical Corp.) which are reactive enough to form coatings on graphite fibers by electropolymerization. Vinyl trimethyl phosphonium bromide (Polysciences) is a vinyl monomer as well as a salt that is amenable to electrodeposition. Similarly, the phosphonium salts, THP sulfate and THP chloride are suitable for electrodeposition. The structural formulae for these compounds are set forth as follows:

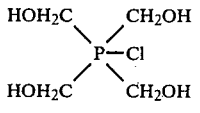

THP chloride
Tetrakis(hydroxymethyl)
phosphonium chloride

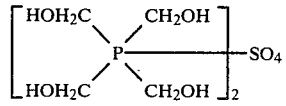

THP sulfate
Tetrakis(hydroxymethyl)
phosphonium sulfate

All of the above organophosphorus compounds have been used commercially as powerful flame retardants. Further potential advantage of coatings of these compounds for interphase modification in composites results from the presence in them of organic functional groups such as hydroxyl groups, which can coreact and/or enhance compatibility with the matrix resin of the graphite fiber.

(3) Phosphato organotitanates

Similarly, organotitanates which have been developed as coupling agents to provide molecular bridges between inorganic fillers and an organic polymer matrix offer unexpected promise for use in the present method. Even though the inorganic coupling group is unlikely to be active in coupling with the graphite fiber surface, other functional groups attached to the titanium, especially phosphate, pyrophosphate, vinyl and acrylic functional groups, make them useful for study in forming flame retardant, char forming coatings on graphite fibers. The mode of applying the organotitanates by electrodeposition or by electropolymerization has been described hereinabove. Thus, the organotitanates which carry pyrophosphate groups, for example, may be electrodeposited; those containing acrylic function may be electropolymerized. It is significant that many of these titanates can be emulsified in water by using anionic or cationic detergents, so that nonionic titanates can be electrodeposited from emulsion. Some examples of organotitanates used thus in this study are given in the table below. These reagents may be obtained from Kenrich Petrochemicals, Inc. Insoluable titanates can be quaternized with triethylenetetramine or other amines to prepare aqueous solutions from which the titanate can be electrodeposited.

and of copolymer composition by chemical analysis. The occurrence of grafting of polymers to carbon fiber can be ascertained by the presence of polymer that cannot be extracted.

Obviously, the treated fibers can be utilized within a wide range of matrix resins, dependent upon particular application requirements.

Four types of titanates

| Titanate | Molecular structure | Typical example |
|---|---|---|
| Monoalkoxy | $RO-Ti(OX^1-R^2-Y)_3$ | Isopropyl, tri(dioctyl-phosphato) titanate |
| Monoalkoxy-pyrophosphato | 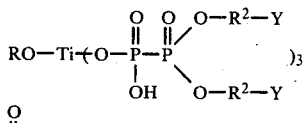 | Isopropyl tri(dioctyl-pyrophosphato) titanate |
| Chelate | 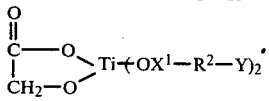 | Titanium di(dioctyl-phosphate) oxyacetate |
| Coordinate | $(RO)_4-Ti(OX^1-R^2-Y)_2$ | Tetroactyloxytitanium di (dilaurylphosphite) titanium |

As with organophosphorus compounds, it should be recognized that phosphato titanates also are flame retardant and will promote char formation. In addition, the long and multifunctional organic groups attached to titanium ensure compatibility of the coating with the matrix resin.

Flame retardant polymer coatings from halogenated monomers have similar effects. Bromostyrene, chlorostyrene, and 2,3-dibromopropyl acrylate and methacrylate are specific examples of such compounds which exemplify the application of electropolymerization of flame retardant monomers on graphite fibers.

It has been intriguing to speculate on the possible effects of a coating of boric acid on graphite fibers. It is relevant to note here that trimethoxyboraxine is a catalyst for epoxy polymerization, and when so used, also catalyzes the formation of intumescent char during burning of the cured resin. The electrodeposition of boric acid on graphite fibers can be conducted at various pH conditions to achieve different degrees of neutralization and formation of different borate species.

FORMATION AND STUDY OF PRECURSOR COATING

Both homopolymerization and copolymerization were conducted. By proper choice of the solvent/electrolyte system, adjustment of concentrations, and variation of the electrical current characteristics, optimum operating conditions can be developed to yield the best obtainable coating on carbon fibers. The rate of polymerization, the thickness of the polymer layer, the molecular weight of the polymer and the composition of the copolymers are controlled by the experimental variables mentioned above.

The variation of current density in the course of polymerization can be plotted by a strip chart recorder. The structure, homogeneity and uniformity of coating on the fiber can be examined by optical and electron microscopy including scanning electron microscopy. The amount of precursor coating formed can be determined by weight increase of the fiber electrode or by change in elemental analysis.

The polymer coating can be extracted from the fibers by suitable solvents for determination of molecular weight by standard methods of solution viscosimetry,

PREPARATION AND TESTING OF COMPOSITES

As one example of an epoxy system, Diglycidyl Ether of bis-Phenol A (DBEBA) resin cured with a stoichiometric quantity of metaphenylene diamine has been demonstrated to be suitable for use as the resin matrix for the preparation of composite specimens in accordance with the present invention. Unidirectional composite specimens can be produced from the aligned, electrocoated fibers by initial preparation of prepregs followed by compression molding. Although strength tests are ultimately crucial, the behavior of the composite under combustion is the primary consideration of the present invention. Therefore, it was necessary to examine the formation of char, its effect on the potential for release of fibers from the burning composite, and the variability of char formation and ease of burning with different types of precursor coatings applied to the fibers.

THERMOGRAVIMETRIC ANALYSIS

A study of the thermal oxidative behavior of the composites by a series of dynamic and isothermal thermogravimetric analyses was utilized. The dynamic analyses were used to indicate the onset of resin and fiber oxidative decomposition. The isothermal analyses were used to determine the time at any temperature required to generate releasable fibers. Microscopy was used to examine the residues after 50% or more weight loss, in order to characterize their physical state. In this manner, a comparison is possible of the dependence of the potential for accidental release of the fibers on the different types of precursor coatings applied.

ELECTRODEPOSITIONS

Weighed lengths of carbon fiber tow, in the form of bundles 12.0±0.5 cm long, tied at both ends, were placed in the center of a single compartment cell containing the electrodeposition solution. Cell dimensions were 8×7×12 cm. The carbon fiber bundle was immersed to a depth of 10.0±0.2 cm. Platinum electrodes were placed on both sides of the bundle at a distance of 3.0 cm. Constant DC voltage was applied to the cell for a selected period of time, after which the fibers were removed, rinsed, and dried at 50° C. for 18 hours in a vacuum oven. The increase in weight of the fiber bundle was then measured and the average weight increase of at least two specimens was recorded.

Pyrophosphato and phosphato titanates can be made water soluble by quaternization. The titanate was slowly titrated with triethylamine (TEA) until the pH was between 6 and 8. The quaternary titanate was then added slowly into water, with constant stirring, using a Waring blender.

Following this procedure, KR-138S, and KR-212 (Kendrich Chemical Co.) shown below were formulated into 5 percent aqueous solutions having the following compositions:

a. Water - 570.0 parts by weight
KR-138S - 20.0
TEA 10.0
b. Water - 950.0 parts by weight
KR-212 - 33.3
TEA - 16.7

KR-138S

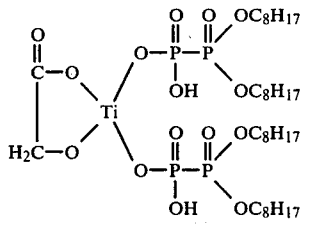

TITANIUM DI(DIOCTYLPYROPHOSPHATE) OXYACETATE

KR-212

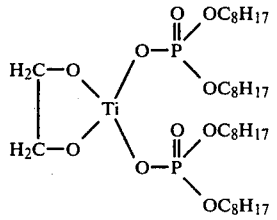

DI(DIOCTYLPHOSPHATO) ETHYLENE TITANATE

Using these solutions, KR-138S and KR-212 were electrodeposited on carbon fiber anodes. Upon completion of the deposition, the fibers were rinsed in water and dried.

THPS-75 (Hooker Chemical), in the form of a 75 percent aqueous solution was used as received. A 5 percent solution was prepared by diluting 40.0 grams of the 75 percent solution to 600 ml with water. THPS-75 were electrodeposited on carbon fiber cathodes. On completion of the deposition, the fibers were rinsed in water and dried. The chemical structure is as follows:

THPS-75 (HOOKER)

TETRAKIS (HYDROXYMETHYL) PHOSPHONIUM SULFATE $[(HO\text{-}CH_2)_4P]_2SO_4$

Phos-Chek 30/P (Monsanto), was prepared as an aqueous solution as follows: One hundred grams of Phos-Chek 30/P was stirred overnight in 500 ml of water. The mixture was then contrifuged and the liquid decanted to remove insoluble Phos-Chek 30/P. The resulting saturated solution was found to contain 1.8 grams Phos-Chek 30/P per 100 ml solution. Phos-Chek 30/P was electrodeposited on carbon fiber anodes which were then rinsed and dried. The chemical structure is as follows:

PHOS-CHEK 30/P

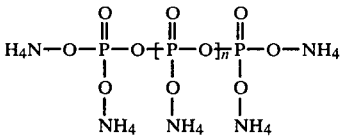

AN AMMONIUM POLYPHOSPHATE

Pyre-ML (Du Pont) is a solution of polyamic acids formed by the reaction of aromatic diamines with aromatic dianhydrides. When Pyre-ML is baked, it is converted to an inert polyimide. Received as a 16.5 percent polymer solids solution in N-Methyl-2-pyrrolidone and aromatic hydrocarbons, a colloidal dispersion of Pyre-ML (#RC-5057) in acetone was prepared as follows. Twenty-five milliliters of Pyre-ML was mixed in 100 ml of dimethylsulfoxide. Five milliliters of triethylamine was added and the solution was heated to 40° C., with stirring, for 15 minutes. The solution was then slowly added to 500 ml of acetone in a Waring blender. Pyre-ML was electrodeposited from this solution on carbon fiber anodes. Upon completion of the deposition, the coated fibers were dried at 150° C. for one hour and were then placed in a vacuum oven for 18 hours at 50° C. No rinsing procedure was employed since it was found experimentally that rinsing in water washed away almost all of the electrodeposited Pyre-ML on the fiber surface.

ELECTROPOLYMERIZATIONS

Electropolymerizations were conducted in the same manner as that described for electrodepositions. Dry solvents, electrolyte, and monomers were used and dry nitrogen was bubbled through the electrolytic solution during polymerization.

An acetylene terminated polyimide, HR 600 (Gulf Chemical) was used as received. Six grams of HR 600 was stirred in 600 ml of dimethylformamide for 24 hours. After settling for an additional 24 hours, the saturated solution was decanted and made 0.2N in $NaNO_3$. Electropolymerization was conducted on carbon fiber cathodes. Upon completion of polymerization, the fibers were rinsed in water and dried. The chemical structure is as follows:

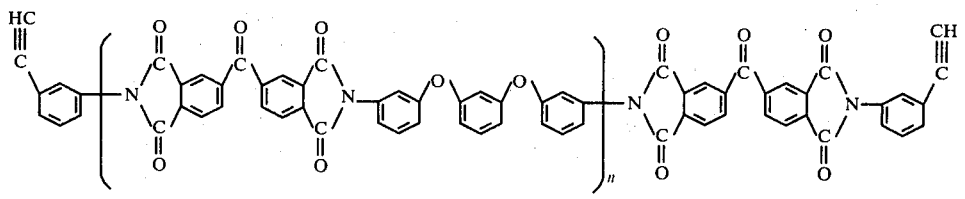

HR600 where n is 1.

Propargyltripheynlphosphonium bromide, PTPPBr (Alfa Chemical) having chemical structure ($HC{=}CHCH_2$) $(C_6H_5)_3PBr$ was used as received. Six grams (0.026 M) of PTPPBr was added to 600 ml of dimethylformamide which was then made 0.2 N in $NaNO_3$. Electropolymerizations were conducted on carbon fiber cathodes after which the fibers were rinsed in water and dried.

THERMAL ANALYSIS

All thermogravimetric analyses (TGA) were performed with a Perkin Elmer TGS-1 Thermoblance. An atmosphere of flowing dry air was delivered from a cylinder of dry air at a rate of 25 ml per minute. Dynamic thermal analysis were conducted at a heating rate of 25 ml per minute. Dynamic thermal analyses were conducted at a heating rate of 10° C. per minute. The variation of weight with increasing temperature was recorded on a strip chart recorder. Data obtained as actual weights as a function of temperature was converted to show the percentage of residual weight and plotted as a function of temperature. Isothermal analysis was performed by raising the temperature of the sample to 500° C. at a heating rate of 80° C. per minute. The sample was allowed to decompose at constant temperature and the variation of weight was recorded as a function of time.

CURED RESINS AND FIRE RETARDANTS

Cured resins and mixtures of epoxy (EPON 828-mPDA) resin and fire retardants were ground into a fine powder in a mortar and pestle and screened through a #40 (0.417 mm mesh) Tyler Standard screen and subjected to thermal analysis as described. Fire retardants (NEAT) were subjected to thermal analysis as received.

Preparation of the cured resins prior to thermal analysis was as follows:

Stoichiometric amounts of EPON 828 and metaphenylenadiamine (mPDA) were heated to 80° C., thoroughly mixed, and precured at 80° C. for one hour. Final curing was done at 150° C. for one hour.

Thermid 600 (HR 600), as received, was placed in an aluminum cup and cured at 315° C. for three hours.

Pyre-ML, as received, was placed in an aluminum cup and cured at 315° C. for two hours.

Mixtures of EPON 828-m-PDA epoxy resin and fire retardants KR-138S, THPS-75, or Chek 30/P were prepared with 2.5 percent and 5 percent fire retardant present by weight. In the first step to prepare the mixture, EPON 828 and the fire retardant were mixed together and heated to 130° C. After thorough mixing, mPDA was added to the hot resin and mixed well. Curing was then performed in two steps, a precure for one hour at 80° C. followed by final curing at 150° C. for one hour.

In this manner, homogenous mixtures of the epoxy resin, and fire retardants KR-138S, and THPS-75 were prepared. The mixture containing Phos-Chek 30/P had a small amount of precipitate in the cured resin.

KR-138S, KR-212, THPS-75, and Phos-Chek 30/P fire retardants were subjected to thermal analysis as received.

FORTAFIL 5U CARBON FIBERS

Fortafil 5U carbon fibers treated by electropolymeriza and electrodeposition were subjected to thermal analysis as short lengths, cut from the treated fiber bundle. Untreated Fortafil 5U fibers were run as received in the same manner. All treated fibers were subjected to a 60 sec., 24 VDC treatment prior to analysis.

COMPOSITES

Composites prepared from treated and untreated Fortafil 5U carbon fibers in an EPON 828-mPDA matrix were subjected to analysis in the form of a single solid chunk cut from the composite specimen. As before, all treated fibers were exposed to a 60 sec. 24 VDC treatment prior to incorporation into a composite. Composite specimens were prepared in the usual manner by compression molding.

RESULTS AND DISCUSSION

Electrochemical Coating Treatments

Measurements of the weight increase of carbon fibers as a function of time at constant applied voltage during electrodepositions and electropolymerizations have shown that the amount of fire retardant or polyimide incorporated into a coating is a function, in most cases, of the applied voltage and the exposure time of the treatment. Little difference was observed between fibers having different elastic moduli.

The amount of deposit was also shown to vary with the type of material being incorporated into the coating. While large weight increases were observed for the organophosphorus titanates and polyimides, comparatively small amounts of the organophosphorus compounds (Phos-Chek 30/P and THPS-75) were found to be deposited on the fiber with little, if any, variation with exposure time. The reason for this may be that a soluble coating is deposited from the organophosphorus titanates, which is then redissolved almost as quickly as it is formed. With the organophosphorus titanates and the polyimides an insoluble or nearly insoluble deposit is likely to be formed, which could account for the larger weight increases.

In summary, the observed results clearly showed that coatings can be formed on carbon fibers by the electrochemical techniques of electrodeposition and electropolymerization of organophosphorus fire retardants and thermally stable polyimides.

Dynamic Thermogravimetric Analysis of Resins and Mixtures

A study of the thermal oxidative behavior of the cured polyimide resins, fire retardants, and fire retardant-epoxy mixtures was undertaken and the results compared to the neat cured epoxy resin used as matrix material in the composite.

The neat epoxy has three major breaks in the TGA curve. One starts at 275° C. and another at 350° C., corresponding to resin decomposition to char, and a third starts at about 450° C. for the oxidation of the char residue. Comparisons to other resins and mixtures will be based on these temperatures.

The polyimides were clearly shown to be more thermally stable than the epoxy resin. In fact, the polyimides did not show any major decomposition below 500° C. At this temperature, the char from the epoxy resin had already begun to decompose. Thus, a polyimide coating on the carbon fibers can survive to a higher temperature. In the composite, the epoxy matrix resin and the resulting char are completely consumed before the polyimide coating begins to decompose. This not only results in holding the fibers together, but also provides an insulating layer on any released fibers, thereby preventing electrical contact.

A study of the effect on the thermal behavior of the epoxy resin of 2.5 and 5.0 weight percent additions of the organophosphorous fire retardants KR-138S, Phos-Chek 30/P, and THPS-75, was conducted and the results compiled.

In all cases, it was observed that the addition of fire retardant increased the amount of char produced and that the onset of decomposition began at a temperature lower than the 275° C. which was observed for the neat epoxy resin. Comparisons of the weight percent remaining at 450° C., just before rapid oxidation of the char residue, show that additions of fire retardants to the resin resulted in char yield of 60 percent or more, while the neat epoxy yielded 45 percent char. It should also be noted that the residual char weight was more when KR138S was present at 2.5 percent concentration than at 5 percent concentration. Similar observations have been made in a study of the efficiency of phosphorus compounds as fire retardants for polyesters.

With respect to the potential release of conductive fibers, the addition of fire retardants results in the conversion of resin to char taking place at a lower temperature and in greater yield than is observed for the neat epoxy resin. Char formation during combustion of carbon fiber composites, binds the fibers together in a clump. When more char is present, there is less potential for fiber release. Where the fire retardant is deposited directly on the fibers themselves, char formation around the fiber increases and, in the event of release, residual char then acts as an electrically insulating coating.

Of special interest was the observed behavior of the organophosphorus titanate KR-138S at temperatures above 600° C. KR-138S and epoxy resin mixtures, showed a residual weight remaining at temperatures up to 900° C. Such residual weight was not observed in the presence of Phos-Chek 30/P or THPS-75. As KR-138S contains titanium, it is likely that this residue is $TiO_2$, an inference supported by the fact that the residue appeared as a white powdery solid on visual inspection. The formation of a thermally stable oxide appears to have important implications. resin and char residue, can still retain an oxide layer. The oxide coating, being nonconductive, greatly reduces the potential for electrical contact and danger to electrical equipment, even in those instances where the fibers are released.

Dynamic Analysis of Coated Fibers

The effect of the coatings on the thermal oxidative behavior of the Fortafil 5U carbon fibers was studied and compared to the untreated fiber behavior. Comparisons of the different coatings clearly show the effects are dependent on the type of coating being put on the fibers. KR-138S showed a decomposition of the fire retardant, starting about 255° C., and a residual weight remaining above 900° C. Similar results were obtained for the organophosphorus titanate KR-212. In addition, the fiber decomposition of the KR-138S coated fiber began at a temperature higher than that of the untreated fiber.

The effect of the organophosphorus compounds Phos-Check 30/P and THPS-75 on the fiber decomposition was similar to that observed for KR-138S. A comparison showed that the untreated fiber had already begun to decompose at 650° C. The coated fibers, on the other hand, did not begin to show any decomposition until about 750° C.

The results of the thermal decomposition of the polyimide coated fibers led to an interesting observation. Fibers coated with polyimides appear to decompose more rapidly than the untreated fiber. HR 600 coated fibers showed a decomposition for the polyimide, beginning at about 500° C., followed by a very rapid fiber decomposition at about 760° C., Pyre-ML likewise appears to influence the fiber decomposition. The decomposition of the Pyre-ML, beginning about 550° C. does not show any clear break before fiber oxidation begins. It appears that polyimide has some catalytic effect on fiber oxidation, decomposing the fiber at a lower temperature than is observed for the untreated fiber.

In the context of this disclosure, several comments can be made. KR-138S, the organophosphorus titanate, was shown to decompose leaving a residue, a titanium salt, that was thermally stable about 900° C. This residue provides an insulating coating on the carbon fibers even after the matrix resin and char are completely consumed.

Polyimides, in addition to being more thermally stable than the epoxy resin, also appear to lower the oxidation temperature of the carbon fibers, making them less thermally stable. This can be seen as an asset in terms of the potential release of carbon fibers during a fire, since the more stable the fiber, the greater the potential for release, simply because of its survival to higher temperatures.

Dynamic Analysis of Composites

Results obtained from the thermo-oxidative behavior of composites prepared from Fortafil 5U carbon fibers coated electrochemically have been analyzed.

Several significant features were observed in the resulting composite decomposition curves. The organophosphorus titanates KR-138S and KR-212 showed that the coated fibers in the composite decompose at a temperature higher than is observed for the untreated fiber. Just as was the case for the coated fibers, for the composite samples, a residual weight remains after complete decomposition of the matrix resin and the carbon fibers. This residue, believed to be $TiO_2$, forms a coating on the fibers as the resin and char decompose, providing a barrier to oxidation of the carbon fibers until a high enough temperature is reached. The coating provides an effective insulating covering on the fibers, reducing their surface conductivity when released into an electrical environment.

Unlike the observed behavior of the coated fibers by themselves, carbon fiber coated with Phos-Chek 30/P has a significantly different oxidative behavior in the composite. Fibers coated with Phos-Chek 30/P, which by themselves did not show fiber decomposition until 750° C., showed a rapid decomposition in the composite, beginning at about 450° C. Likewise, when compared to the fiber decomposition in the untreated composite, the Phos-Chek 30/P coated fibers were observed to decompose at a temperature lower than was observed for untreated fibers. Apparently, the combination of Phos-Chek 30/P and the epoxy resin has a synergistic effect on the oxidation of the carbon fibers.

In the presence of THPS-75, the fiber decomposition in the composite occurs at a higher temperature than is observed in the untreated fiber composite and at about the same temperature as THPS-75 treated fibers by themselves.

Finally, the thermal behavior of composites prepared from polyimide-coated fibers was observed. The fiber decomposition in the polyimide-coated fiber composites occurred at a temperature somewhat lower than that observed in the untreated fiber composite. This again suggests that the decomposition of the polyimides in some manner catalyzes the oxidation of the fiber, as was observed with the coated fibers themselves. Also, a comparison of the thermal decomposition of the neat resins and the fiber decompositions in the composites leads to an interesting result. This comparison shows that the decompositions of the cured neat HR-600 and Pyre-ML resins correspond, almost exactly, to the observed fiber decompositions in the composites. This observation adds support to the occurrence of an interaction between the polyimide resin and carbon fiber decomposition behavior.

SUMMARY AND CONCLUSIONS

In summary, the thermal oxidative behavior of the neat resins, coated fibers, and composites have shown that electrochemical treatments resulting in the deposition of either organophosphorus fire retardants or polyimides have significant effects on the behavior of carbon fiber epoxy matrix composites. Addition of organophosphorus fire retardants promotes char formation of the matrix resin. Organophosphorus titanates leave a white powder residue believed to be $TiO_2$. Polyimides are not only more thermally stable than the epoxy resins, but also reduce the thermal stability of the carbon fiber substrate.

Other effects of the coatings on the decomposition of the carbon fibers were observed. THPS-75 and KR-138S coatings were observed to increase fiber stability in the composite decompositions while Phos-Chek 30/P lowered fiber stability under the same conditions. All of these effects assist in either preventing the release of carbon fibers into the environment or result in a fiber having a reduced conductivity, thereby preventing electrical contact once the fiber is released.

Having described our invention, we claim:

1. A method of preventing the shorting of an electrical component caused by contact with electrically conductive carbon fibers, wherein the carbon fibers are released from a composite upon exposure of the composite to fire, and wherein the composite is located in the proximity of the electrical component and is comprised of the carbon fibers and a polymeric matrix material, which comprises:

electrocoating the surfaces of the carbon fibers before incorporation thereof into the composite with a coating material that will accelerate the decomposition of the coated carbon fibers when the composite is exposed to fire or which will lead to the formation of a high electrical resistance coating in situ or fiber clumps when the coated carbon fibers within the composite are subsequently exposed to fire, the composite being adapted for use in the proximity of the electrical component such that upon exposure of the composite to fire the decomposition products of the composite will be free from electrically conductive, short circuit-causing carbon fibers.

2. A method as set forth in claim 1 wherein the coating material forms a high temperature resistant polymer coating on the carbon fiber surfaces.

3. A method as set forth in claim 1 wherein the coating material forms a high temperature resistant polymer coating on the carbon fiber surfaces and is selected from a group consisting of acetylene-terminated polyimide intermediates, acetylene or nitrile terminated polyquinolxaline oligomers, benzonitrile, acrylonitrile, and polyamic acids.

4. A method as set forth in claim 1 wherein the coating material forms a high temperature resistant polymer coating on the carbon fiber surfaces and is electrocoated thereon by electropolymerization of acetylene-terminated polyimide intermediates.

5. A method as set forth in claim 1 wherein the coating material forms a high temperature resistant polymer coating on the carbon fiber surfaces and is electrocoated thereon by electrodeposition or electropolymerization of polyamic acids.

6. A method as set forth in claim 1 wherein the coating material forms an electrically nonconductive, flame retardant, char-producing coating on the carbon fiber surfaces.

7. A method of preventing shorting of electrical components by the release of carbon fibers from a composite comprised of the carbon fibers and a polymeric matrix material upon exposure of the composite to fire, which comprises:

electrocoating the surfaces of the carbon fibers before incorporation thereof into the polymeric matrix material or a precursor thereof with a coating material which forms an electrically nonconductive, flame retardant char producing coating on the carbon fiber surfaces and which is selected from the group consisting of inorganic or organic phosphorous containing compounds.

8. A method of preventing shorting of electrical components by the release of carbon fibers from a composite comprised of the carbon fibers and a polymeric matrix material upon exposure of the composite to fire, which comprises:

electrocoating the surfaces of the carbon fibers before incorporation thereof into the polymeric matrix material or a precursor thereof with a coating material which forms an electrically nonconductive, flame retardant, char-producing coating on the carbon fiber surfaces and which is applied thereon by electrodeposition or electropolymerization of organophosphorous compounds.

9. A method of preventing shorting of electrical components by the release of carbon fibers from a composite comprised of the carbon fibers and a polymeric matrix material upon exposure of the composite to fire, which comprises:

electrocoating the surfaces of the carbon fibers before incorporation thereof into the polymeric matrix material or a precursor thereof with a coating material which forms an electrically nonconductive, flame retardant, char-producing coating on the carbon fiber surfaces and which is applied thereon by electrodeposition or electropolymerization of organotitanate compounds.

10. A method as set forth in claim 1 wherein the formed coating material accelerates the decomposition of coated carbon fibers within a composite matrix when the composite is exposed to fire and is selected from a group consisting of vinyl acetylene or nitrile terminated polyimide intermediates, polyamic acids and inorganic or organic phosphorous compounds.

11. A method of preventing shorting of electrical components by the release of carbon fibers from a composite comprised of the carbon fibers and a polymeric matrix material upon exposure of the composite to fire, which comprises:

electrocoating the surfaces of the carbon fibers before incorporation thereof into the polymeric matrix material or a precursor thereof with boric acid.

12. The product resulting from electrocoating carbon fibers with a phosphorous-containing compound.

13. The product resulting from electrocoating carbon fibers with a titanate compound.

14. The product resulting from electrocoating carbon fibers with a high temperature polymer by electropolymerization of a precursor selected from the group consisting of acetylene-terminated polyimide intermediates, and polyamic acids.

15. The product resulting from electrocoating carbon fibers with boric acid.

* * * * *